US009561939B1

(12) United States Patent
Kusaka

(10) Patent No.: US 9,561,939 B1
(45) Date of Patent: Feb. 7, 2017

(54) CRANE HOOK AND CRANE TRUCK

(71) Applicant: Tadano Ltd., Takamatsu (JP)

(72) Inventor: Yoshiyasu Kusaka, Kagawa (JP)

(73) Assignee: Tadano Ltd., Takamatsu (JP)

( * ) Notice: Subject to any disclaimer, the term of this patent is extended or adjusted under 35 U.S.C. 154(b) by 0 days.

(21) Appl. No.: 15/209,062

(22) Filed: Jul. 13, 2016

(30) Foreign Application Priority Data

Jul. 17, 2015 (JP) ..... 2015-143258

(51) Int. Cl.
*B66C 1/34* (2006.01)
*B66C 1/36* (2006.01)
*B66C 23/42* (2006.01)

(52) U.S. Cl.
CPC ..... *B66C 1/36* (2013.01); *B66C 23/42* (2013.01); *B66C 2700/0371* (2013.01)

(58) Field of Classification Search
CPC .... B66C 23/42; B66C 2700/0371; B66C 1/36; B66C 1/12; F16B 45/02
See application file for complete search history.

(56) References Cited

U.S. PATENT DOCUMENTS 1,239,301 A * 9/1917 Pearson ..... F16B 45/02 24/599.4
1,949,608 A * 3/1934 Johnson ..... F16B 45/02 24/599.5
2,010,733 A 8/1935 Netz
2,905,997 A * 9/1959 Ramskill ..... B66C 1/36 24/599.2
3,575,458 A 4/1971 Crook, Jr. et al.
3,827,746 A * 8/1974 Byers ..... B66C 1/36 24/599.5

(Continued)

FOREIGN PATENT DOCUMENTS

JP 39-28932 U 10/1964
JP 47-42761 U 12/1972

(Continued)

OTHER PUBLICATIONS

Office Action for Japanese Application No. 2015-143258, dated Nov. 17, 2015.

(Continued)

*Primary Examiner* — Stephen Vu
(74) *Attorney, Agent, or Firm* — Marshall, Gerstein & Borun LLP

(57) ABSTRACT

A hook has a hook body which has an attachment portion to be attached to a rope at a base end portion and which is curved in an L-shaped from the base end portion to a tip end portion, a latching tool which is rotatably supported by the hook body and which is brought into contact with and separated from a curved inner surface of the hook body on the tip end portion side of the hook body relative to a rotation center, a biasing member biasing the latching tool in a direction where the latching tool is caused to abut on the hook body, and a lock pin which is detachable from and attachable to the latching tool between the rotation center and a rotation tip and which abuts on the curved inner surface of the hook body when the lock pin is attached to the latching tool to regulate the rotation of the latching tool against biasing force of the biasing member.

10 Claims, 8 Drawing Sheets

(56) References Cited

U.S. PATENT DOCUMENTS

| | | | | |
|---|---|---|---|---|
| 4,440,432 | A * | 4/1984 | Goris | B66C 1/36 24/599.8 |
| 5,020,843 | A | 6/1991 | Lucas | |

FOREIGN PATENT DOCUMENTS

| | | | |
|---|---|---|---|
| JP | 51-162470 | U | 12/1976 |
| JP | 54-38280 | U | 3/1979 |
| JP | 56-93509 | U | 7/1981 |
| JP | 62-52310 | U | 4/1987 |
| JP | 5-12484 | U | 2/1993 |
| JP | 7-31780 | U | 6/1995 |
| JP | 10-37228 | A | 2/1998 |
| JP | 2003-042119 | A | 2/2003 |
| JP | 2006-037604 | A | 2/2006 |

OTHER PUBLICATIONS

Decision to Grant a Patent for Japanese Application No. 2015-143258, dated Mar. 22, 2016.

* cited by examiner

CRANE HOOK AND CRANE TRUCK

CROSS-REFERENCE TO RELATED APPLICATION

This application claims the benefit of priority under 35 U.S.C. §119 of Japanese Patent Application No. 2015-143258 filed on Jul. 17, 2015.

BACKGROUND OF THE INVENTION

Field of the Invention

The present invention relates to a crane hook locking a wire and the like attached to a hoisted load.

Description of the Related Art

Heretofore, hooks attached to a crane and the like have been provided with a latching tool in order to prevent the removal of a wire and the like locked to the hook. The latching tool is rotatably supported by the hook and is biased in a direction where the latching tool is caused to abut on the tip of the hook. By rotating the latching tool against the biasing force, the wire and the like is detachable from and attachable to the hook.

When a hoisted load attached to the tip of a wire is placed on the ground in a state where the wire locked to the hook of the above-described configuration is twisted, the bent wire is sometimes deformed in such a manner as to eliminate the twist. In this case, the deformed wire may rotate the latching tool to be disconnected from the hook. Then, Japanese Unexamined Utility Model (Registration) Application Publication No. 7-31780 discloses a crane hook further having a lock pin which prevents the rotation of the latching tool.

However, the lock pin described in Japanese Unexamined Utility Model (Registration) Application Publication No. 7-31780 prevents the rotation of a latching tool by abutting on the latching tool at a position furthest from the rotation tip of the latching tool which is brought into contact with and separated from a the hook. Therefore, there has been a problem that a position where the lock pin is attached to and detached from the latching tool and a position where a wire is attached to and detached from the hook are separated from each other, which reduces the workability. This problem becomes more remarkable with an increase in the size of the hook.

SUMMARY OF THE INVENTION

The present invention has been made in view of the above-described problem. It is an object of the present invention to provide a crane hook capable of preventing the removal of a wire and the like locked to a hook body by a simple operation and in an appropriate manner.

(1) A crane hook according to the present invention is suspended from a rope. The crane hook has a hook body which has an attachment portion to be attached to the rope at a base end portion and which is curved in an L-shaped from the base end portion to a tip end portion, a shaft being fixed to the hook body, a rotation member being rotatably supported by the shaft and having an abutment portion to be brought into contact with and separated from a curved inner surface of the hook body on the tip end portion side of the hook body relative to the shaft, a biasing member biasing the rotation member in a direction, and a regulating member being detachable from and attachable to the rotation member. The rotation member has a plurality of through-holes penetrating in an extending direction of the shaft, the through-holes including a first through-hole through which the regulating member is passed, a second through-hole into which the shaft is passed at position distant from the abutment portion relative to the first through-hole, and a third through-hole through which the regulating member is passed at a position distant from the abutment portion relative to the second through-hole. The regulating member abuts on a curved inner surface of the hook body when the regulating member is passed through the first through-hole to regulate rotation of the rotation member against biasing force of the biasing member. The regulating member permits the rotation of the rotation member when the regulating member is passed through the third through-holes.

According to the configuration described above, the rotation of the rotation member against the biasing force of the biasing member is regulated by the regulating member, and therefore the removal of a wire and the like locked to the hook body can be appropriately prevented. Moreover, since the attachment position of the regulating member is close to the abutment portion of the rotation member, an operation of detaching/attaching the regulating member from/to the rotation member and an operation of detaching/attaching a wire and the like from/to the hook body can be smoothly performed. The attachment position of the regulating member is close to the abutment portion of the rotation member, and therefore an operation of detaching/attaching the regulating member from/to the rotation member and an operation of detaching/attaching a wire and the like from/to the hook body can be smoothly performed. The third through-hole is formed at the position distant from the first through-hole relatives to the second through-hole. Therefore, when the rotation member is rotated in a direction where the first through-hole is brought close to the hook body, the third through-hole moves away from the hook body. Then, by passing the regulating member through the third through-hole when detaching/attaching a wire and the like from/to the hook body, the rotation of the rotation member is not blocked and the loss or the like of the regulating member can be prevented.

(2) Preferably, the rotation member has a main plate having a rotation tip serving as the abutment portion and a pair of side plates which are extended in a direction crossing the main plate from both end portions in the rotation axis direction of the main plate and each having the first through-hole, the second through-hole and the third through-hole.

According to the configuration described above, the regulating member is supported at two places by the pair of side plates and abuts on the hook body between the support positions, and therefore the rotation of the rotation member can be stably regulated.

(3) For example, the regulating member has a bar-shaped pin having an outer diameter size smaller than the diameter of the first through-holes and an engagement member capable of changing the attitude between an engaged attitude in which the engagement member is engaged with the side plate defining the peripheral edge of the first through-hole and a disengaged attitude in which the engagement with the sideplate is released.

(4) Preferably, the engagement member has an engagement portion provided at a position where the regulating member passes through at least one of the pair of first through-holes when the regulating member is attached to the rotation member. The engagement member is biased in a direction where the attitude is changed to the engaged attitude in which the engagement portion is projected from the pin and the disengaged attitude in which the engagement portion is sunk into the pin and where the engaged attitude is maintained.

According to the configuration described above, the engagement member is biased so as to maintain the engaged attitude, and therefore the removal of the regulating member from the rotation member due to vibration and the like can be prevented.

(5) Preferably, the engagement member is formed by bending a long member. The engagement member which is elastically deformed with the bent portion as the base point tends to return to a natural state where a first portion of one side of the bent portion and a second portion of the other side of the bent portion are separated from each other by only a predetermined distance. The engagement portion is provided in the second portion. The pin has an internal space accommodating the engagement member in a compressed state in which the first portion and the second portion are closer to each other than the natural state, a locking portion locking the first portion of the engagement member accommodated in the internal space, and a slit from/into which the engagement portion of the engagement member accommodated in the internal space is projected/sunk.

According to the configuration described above, the engagement member accommodated in the internal space of the pin tends to return to the natural state from the compressed state. Thus, the engagement member is biased in a direction where the engagement portion is projected from the slit (i.e., the engagement member maintains the engaged attitude).

(6) As another example, the pin has an internal space accommodating the engagement member having a long shape, a shaft extending in the lateral direction of the pin and rotatably supporting the engagement member, a slit from/into which the engagement portion is projected/sunk, and a biasing member biasing the engagement member in a direction where the engagement portion is projected through the slit.

(7) Preferably, the engagement portion has a first inclined surface where the projection amount continuously decreases toward an insertion direction of the pin and a second inclined surface where the projection amount continuously decreases toward a removal direction of the pin. The inclination angle of the first inclined surface is smaller than the inclination angle of the second inclined surface.

According to the configuration described above, when the regulating member is inserted into the first through-hole, the first inclined surface abuts on the side plate and when the regulating member is removed from the first through-hole, the second inclined surface abuts on the side plate. Herein, by setting the inclination angle of the first inclined surface to be smaller than that of the second inclined surface, the engagement portion is easily sunk into the pin in the insertion and the engagement portion is not easily sunk into the pin in the removal. As a result, the insertion of the regulating member is facilitated and also unexpected removal of the regulating member from the rotation member can be prevented.

(8) Preferably, the slit is formed in a rear end portion in the insertion direction of the pin. The engagement member has an operating portion which is exposed from the pin on the rear side in the insertion direction of the pin relative to the engagement portion and which causes the engagement portion to sink into the pin by being operated by an operator. When the regulating member is attached to the rotation member, the regulating member is disposed in such a manner as to hold the side plate on the rear side in the insertion direction of the pin between the engagement portion and the operating portion.

According to the configuration described above, the regulating member can be drawn out of the rotation member by operating the operating portion to cause the engagement portion to sink into the pin. As a result, unexpected removal of the regulating member from the rotation member can be prevented and also the regulating member can be easily removed from the rotation member.

(9) As a still another example, the engagement member has a coil portion in which a linear member is formed in a coil shape, a first arm portion which is extended from one end portion of the coil portion and is bent, and a second arm portion which is extended from the other end portion of the coil portion and is bent. The engagement portion includes the bent portions of the first arm portion and the second arm portion. The pin has an internal space accommodating the engagement member in a state where the coil portion is twisted in a direction where the first arm portion and the second arm portion are brought close to each other, a shaft which extends in the lateral direction of the pin and is passed through the coil portion, a first slit from/into which the engagement portion of the first arm portion is projected/sunk, and a second slit from/into which the engagement portion of the second arm portion is projected/sunk.

(10) A crane truck according to the present invention has a traveling body, a slewing body slewably supported by the traveling body, a boom derrickably and telescopably supported by the slewing body, and the crane hook described above suspended from the tip end portion of the boom with a rope.

According to the configuration described above, a crane truck capable of preventing the removal of a wire and the like locked to a hook body by a simple operation and in an appropriate manner can be obtained.

According to the present invention, the rotation of the rotation member against the biasing force of the biasing member is regulated by the regulating member, and therefore the removal of a wire and the like locked to the hook body can be appropriately prevented. Moreover, the attachment position of the regulating member is close to the abutment portion of the rotation member, and therefore an operation of detaching/attaching the regulating member from/to the rotation member and an operation of detaching/attaching a wire and the like from/to the hook body can be smoothly performed.

BRIEF DESCRIPTION OF THE DRAWINGS

FIGS. 2A and 2B are perspective views of a hook 32, in which FIG. 2A illustrates a state where a latching tool 50 is located at an abutting position and FIG. 2B illustrates a state where the latching tool 50 is located at a separated position.

FIGS. 4A to 4C are views illustrating a lock pin 60 according to this embodiment, in which FIG. 4A illustrates an exploded perspective view, FIG. 4B illustrates a cross-sectional perspective view when an engagement member 70 is in an engaged attitude, and FIG. 4C is a cross-sectional perspective view when the engagement member 70 is in a disengaged attitude.

FIGS. 5A to 5C are views illustrating a lock pin 80 according to modification 1, in which FIG. 5A illustrates an exploded perspective view, FIG. 5B illustrates a cross-sectional perspective view when an engagement member 90 is in an engaged attitude, and FIG. 5C illustrates a cross-sectional perspective view when the engagement member 90 is in a disengaged attitude.

FIGS. 6A to 6C are views illustrating a lock pin 100 according to modification 2, in which FIG. 6A illustrates an exploded perspective view, FIG. 6B illustrates a cross-sectional perspective view when an engagement member 110 is in an engaged attitude, and FIG. 5C illustrates a cross-sectional perspective view when the engagement member 110 is in a disengaged attitude.

DESCRIPTION OF THE PREFERRED EMBODIMENTS

Figure 1:
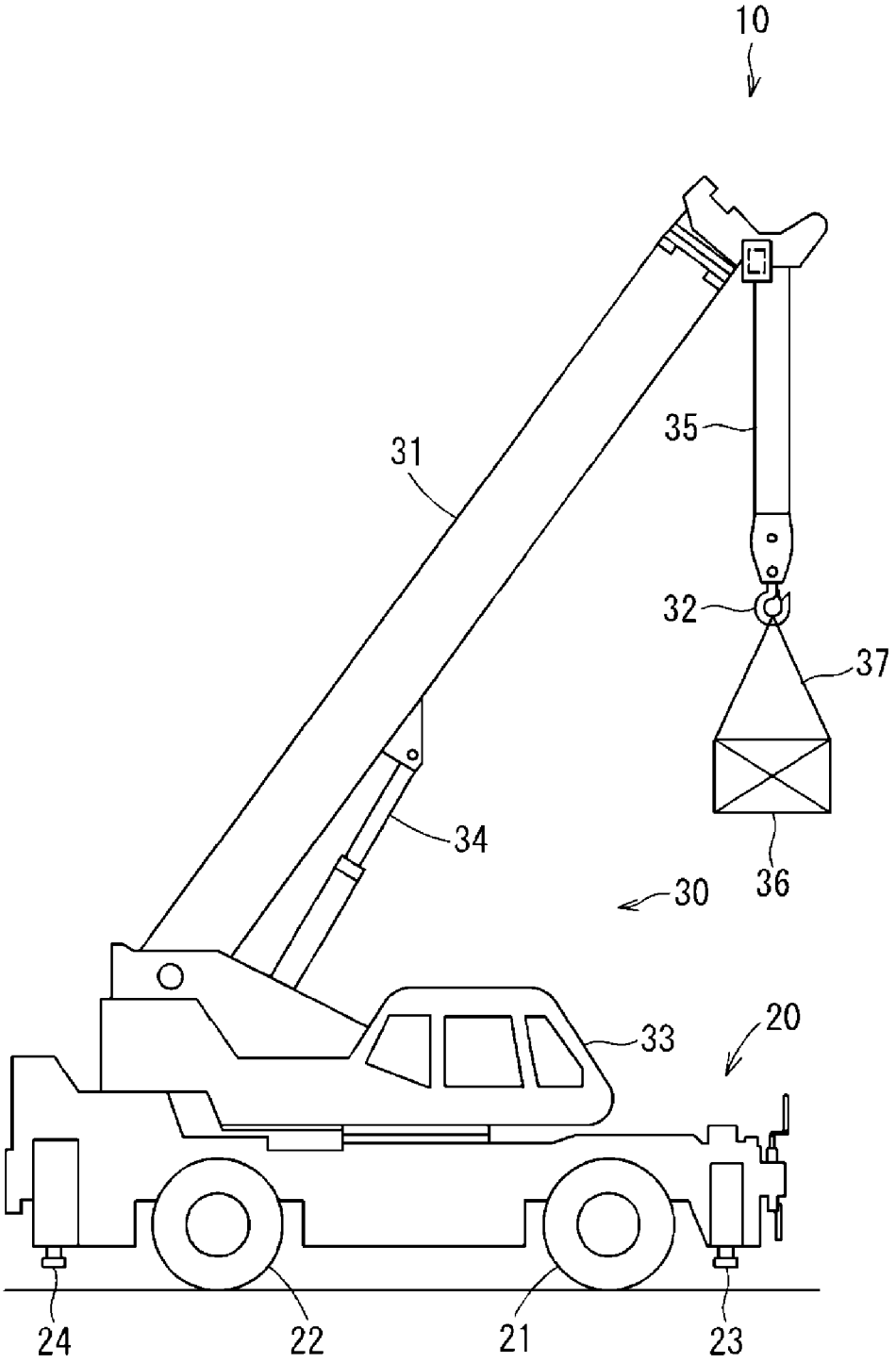
FIG. 1 is a schematic diagram of a rough terrain crane 10 according to this embodiment.

Hereinafter, a preferable embodiment of the present invention is described referring to the drawings as appropriate. The embodiments simply describe one aspect of the present invention. It is a matter of course that the embodiment may be altered insofar as the scope of the present invention is not altered.

Rough Terrain Crane 10

A rough terrain crane 10 according to this embodiment mainly has a lower traveling body (an example of the traveling body) 20 and an upper slewing body (an example of the slewing body) 30 as illustrated in FIG. 1. The rough terrain crane 10 is an example of a crane truck. However, a specific example of the crane truck is not limited to the rough terrain crane 10 and, for example, an all terrain crane, a cargo crane, and the like may be acceptable.

Lower Traveling Body 20

The lower traveling body 20 has a pair of right and left front wheels 21 and a pair of right and left rear wheels 22 (Only the right wheels are illustrated in FIG. 1). The front wheels 21 and the rear wheels 22 are rotated by driving force of an engine (not illustrated) transmitted through a transmission (not illustrated). The lower traveling body 20 travels when a steering, an accelerator pedal, a brake pedal, and the like provided in a cabin 33 described later are operated by an operator.

The lower traveling body 20 has a pair of right and left outriggers 23 provided on the front side of the lower traveling body 20 and a pair of right and left outriggers 24 provided on the rear side of the lower traveling body 20 (Only the right outriggers are illustrated in FIG. 1). The outriggers 23 and 24 can change the state between an extended state in which the outriggers 23 and 24 are grounded on the ground at positions extended in the right and left direction from the lower traveling body 20 and a housed state in which the outriggers 23 and 24 are housed in the lower traveling body 20 in the state where the outriggers 23 and 24 are separated from the ground. The attitude of the rough terrain crane 10 is stabilized by setting the outriggers 23 and 24 to the extended state during an operation of an upper slewing body 30. On the other hand, the outriggers 23 and 24 are set to the housed state during travelling of the lower traveling body 20.

Upper Slewing Body 30

The upper slewing body 30 is slewably supported by the lower traveling body 20 through a slewing bearing (not illustrated). The upper slewing body 30 is slewed by a slewing motor (not illustrated). The upper slewing body 30 mainly has a telescopic boom (an example of the boom) 31, a hook (an example of the crane hook) 32, and the cabin 33 as illustrated in FIG. 1.

The telescopic boom. 31 is derrickably and telescopably supported by the upper slewing body 30. The telescopic boom 31 is derricked by a derricking cylinder 34 and is telescoped by a telescopic cylinder (not illustrated). The telescopic boom 31 is not limited to a boom with a box type structure and may be a jib with a lattice structure. The hook 32 is suspended from a rope 35 extended downwardly from the tip end portion of the telescopic boom 31. The hook 32 is raised and lowered by winding up and unwinding the rope 35 with a winch (not illustrated). By operating various levers and the like provided in the cabin 33, the upper slewing body 30 is slewed, the telescopic boom 31 is derricked and telescoped, and the hook 32 is raised and lowered.

Hook 32

Figure 2A:
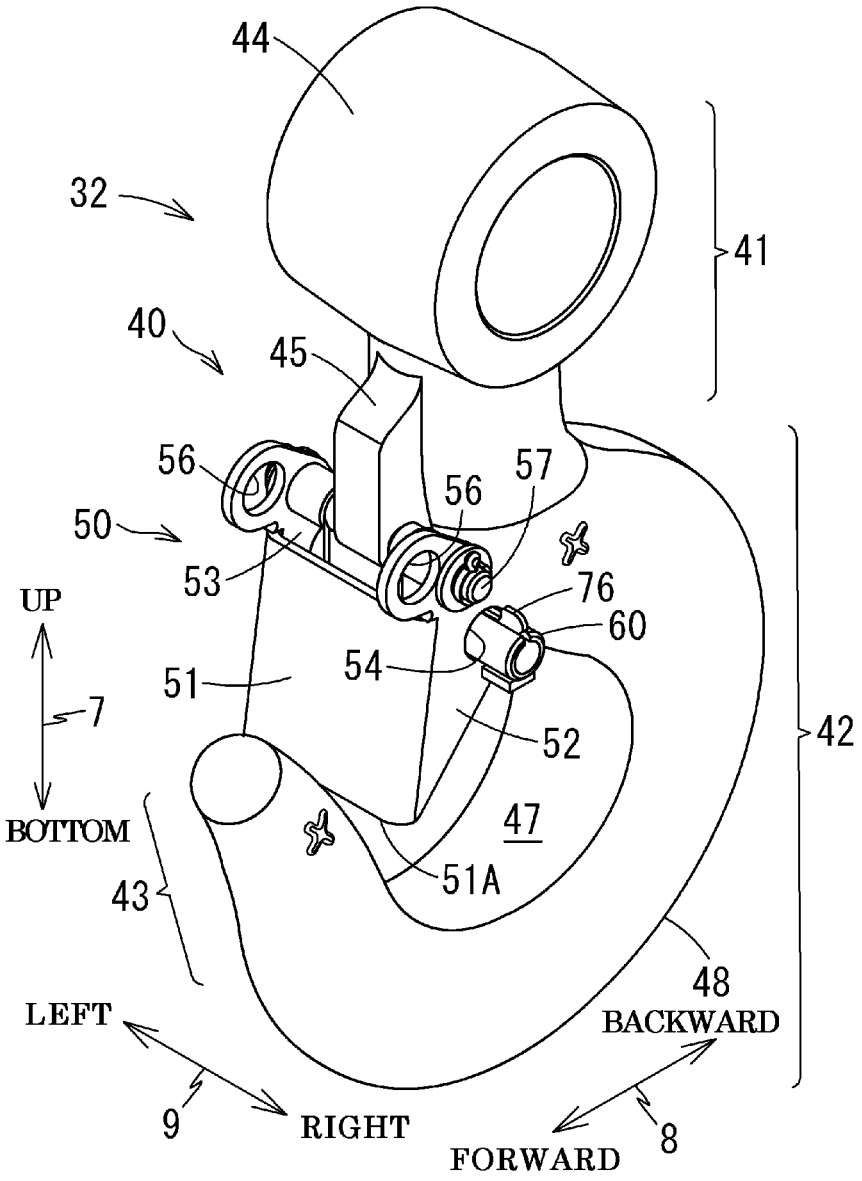
Figure 2B:
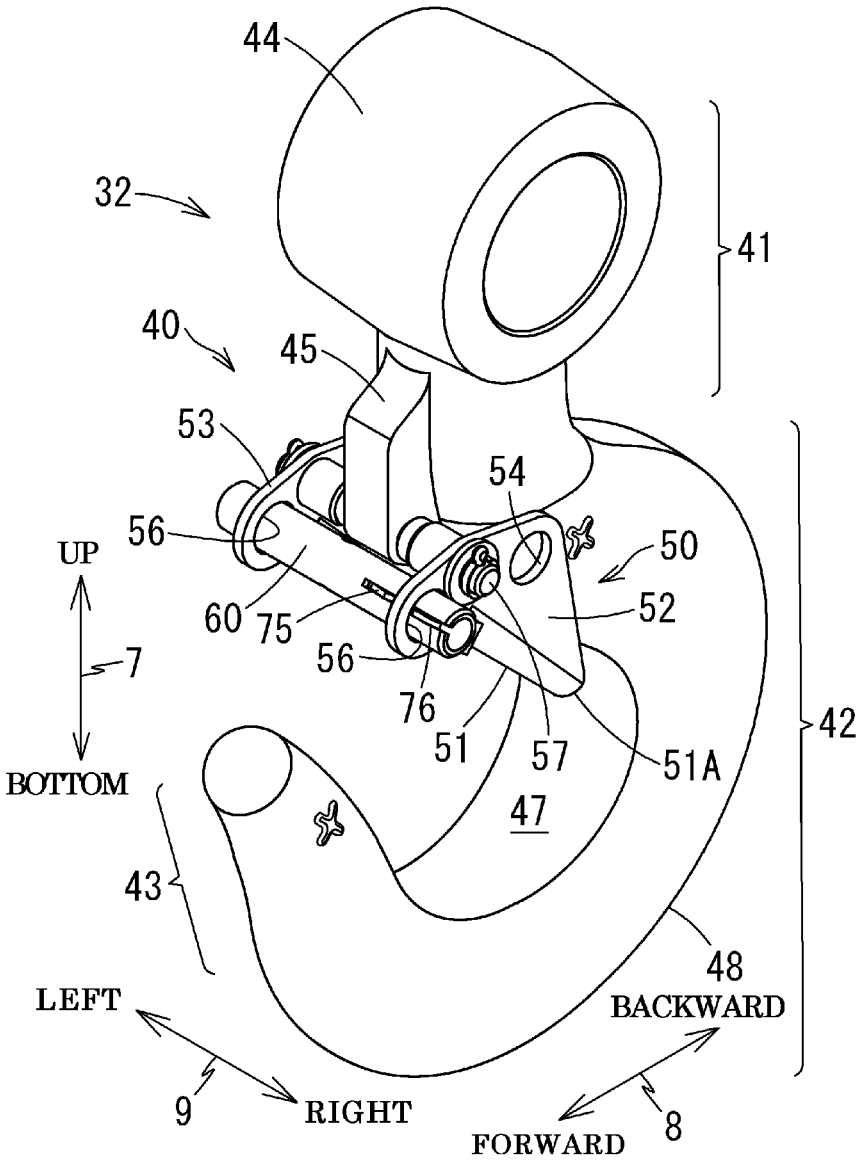
Figure 3:
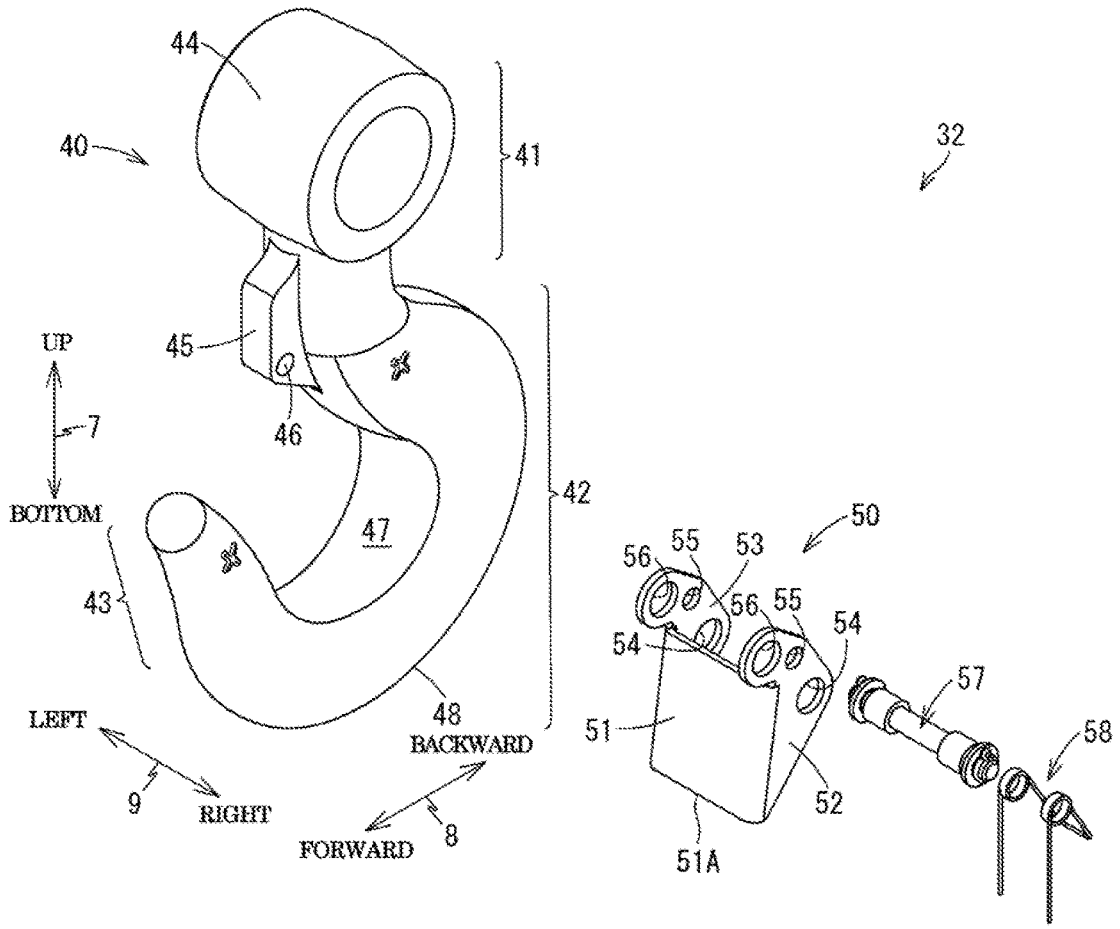
FIG. 3 is an exploded perspective view of the hook 32.

The hook 32 locks a wire 37, to the tip of which a hoisted load 36 is attached, as illustrated in FIG. 1. The hook 32 mainly has a hook body 40, a latching tool (an example of the rotation member) 50, and a lock pin (an example of the regulating member) 60 as illustrated in FIGS. 2A and 2B and FIG. 3. The parts configuring the hook 32 are formed of metal materials, for example.

Hook Body 40

The hook body 40 has a base end portion 41, a curved portion 42, and a tip end portion 43 as illustrated in FIGS. 2A, 2B and 3. The hook body 40 is curved in an L-shaped from the base end portion 41 to the tip end portion 43. The boundary between the base end portion 41, the curved portion 42, and the tip end portion 43 does not necessarily need to be clear. Hereinafter, the vertical direction is an up and down direction 7, a direction where the base end portion 41 and the tip end portion 43 face each other among horizontal directions is a forward and backward direction 78, and a direction orthogonal to the up and down direction 7 and the forward and backward direction 8 among horizontal directions is a right and left direction 9.

The base end portion 41 has a ring-shaped attachment portion 44 through which the rope 35 can be passed and a mount 45 projecting toward the tip end portion 43 at a position closer to the curved portion 42 relative to the attachment portion 44. By passing the rope 35 through the attachment portion 44, the hook 32 is attached to the rope 35. The mount 45 has a through-hole 46 penetrating in the right and left direction 9. The mount 45 supports a shaft 57 passed through the through-hole 46. More specifically, the shaft 57 is fixed to the mount 45 and is extended in the right and left direction 9. The right and left direction 9 is an example of the rotation axis direction.

The curved portion 42 is an arc-shaped portion, one end of which contacts the base end portion 41 and the other end of which contacts the tip end portion 43. The tip end portion 43 is curved in a direction away from the base end portion 41 and has a tapered shape in which the tip end portion 43 becomes narrower toward the tip. Hereinafter, the surface of the inner side of the curve of the curved portion 42 and the surfaces of the base end portion 41 and the tip end portion 43 continuous to the surface of the inner side of the curve of the curved portion 42 are indicated as a "curved inner surface 47 of the hook body 40". On the other hand, the surface of the outer side of the curve of the curved portion 42 and the surfaces of the base end portion 41 and the tip end portion 43 continuous to the surface of the outer side of the curve of the curved portion 42 are indicated as a "curved outer surface 48 of the hook body 40".

Latching Tool 50

The latching tool 50 is rotatably supported by the hook body 40. More specifically, the latching tool 50 is rotatably supported by the shaft 57 fixed to the through-hole 46 of the mount 45. The latching tool 50 is configured to be rotatable between an abutting position (refer to FIG. 2A) where a rotation tip (an example of the abutment portion) 51A of a main plate 51 abuts on the curved inner surface 47 of the hook body 40 and a separated position (refer to FIG. 2B) where the rotation tip 51A is separated from the curved inner surface 47 of the hook body 40.

The rotation tip 51A of the latching tool 50 at the abutting position abuts on the curved inner surface of the hook body 40 on the side of the tip end portion 43 of the hook body 40 relative to the rotation center of the latching tool 50 as illustrated in FIG. 2A. Thus, the hook body 40 and the latching tool 50 configure a ring continuous in the circumferential direction to prevent the fall of the wire 37 locked to the hook body 40. On the other hand, as illustrated in FIG. 2B, when the latching tool 50 is located at the separated position, a part in the circumferential direction of the ring is separated, so that the wire 37 can pass through a gap between the latching tool 50 and the hook body 40.

The latching tool 50 is biased toward the abutting position by a twisted coil spring (an example of the biasing member) 58 as illustrated in FIG. 3. In the twisted coil spring 58, a coil portion is passed through the shaft 57. The twisted coil spring 58 biases the latching tool 50 toward the abutting position by causing one arm of the twisted coil spring 58 to abut on the latching tool 50 and causing the other arm of the twisted coil spring 58 to abut on the curved inner surface 47 of the hook body 40. The latching tool 50 is held at the abutting position by the biasing force of the twisted coil spring 58 in an unloaded state (in a state where no external force other than gravity is applied). On the other hand, the latching tool 50 rotates to the separated position against the biasing force by the application of external force in a direction opposite to the direction of the biasing force of the twisted coil spring 58.

The latching tool 50 has the main plate 51 and a pair of side plates 52 and 53. The main plate 51 and the side plates 52 and 53 are formed by bending a flat plate, for example. The side plates 52 and 53 are extended in a direction crossing the main plate 51 from both end portions in the right and left direction 9 of the main plate 51. The separated distance between the pair of side plates 52 and 53 is larger than the thickness in the right and left direction 9 of the hook body 40. More specifically, when the latching tool 50 is located at the separated position illustrated in FIG. 2B, the side plates 52 and 53 do not contact the hook body 40. In other words, when the latching tool 50 is located at the separated position, the pair of side plates 52 and 53 are disposed in such a manner as to hold the hook body 40 therebetween in the right and left direction 9.

Each of the side plates 52 and 53 have through-holes 54, 55, and 56 penetrating in the right and left direction 9 formed at positions corresponding to each other in the up and down direction 7 and in the forward and backward direction 78. The pair of through-holes 54 (an example of the first through-holes) are formed at positions distant from the main plate 51 relative to the through-holes 55 and 56. The pair of through-holes 55 (an example of the second through-holes) are formed at positions distant from the rotation tip 51A relative to the through-holes 54. Through the pair of through-holes 55, the shaft 57, which is inserted into and fixed to the through-hole 46 of the mount 45, is passed. The pair of through-holes 56 (an example of the third through-holes) are formed at positions distant from the through-holes 54 relative to the through-holes 55. The lock pin 60 can be inserted into/removed from the pair of through-holes 54 and the pair of through-holes 56 as illustrated in FIGS. 2A and 2B.

As illustrated in FIG. 2A, the lock pin 60 inserted into the pair of through-holes 54 regulates the rotation of the latching tool 50 to the separated position. More specifically, when the latching tool 50 is disposed at the abutting position, the lock pin 60 inserted into the pair of through-holes 54 is separated from the hook body 40. When the latching tool 50 rotates to the separated position from the abutting position, the lock pin 60 inserted into the through-holes 54 abuts on the curved inner surface 47 of the hook body 40 between the pair of side plates 52 and 53 in the right and left direction 9.

On the other hand, in the state where the lock pin 60 is removed from the through-holes 54 as illustrated in FIG. 2B, the latching tool 50 can rotate between the abutting position and the separated position. When the latching tool 50 is caused to rotate to the separated position, the lock pin 60 can be passed through the pair of through-holes 56. The through-holes 54 and 56 are formed on the opposite sides with the through-holes 55 serving as the rotation center interposed therebetween. Therefore, when the latching tool 50 rotates to the separated position (i.e., in a direction where the through-holes 54 are brought close to the curved inner surface 47 of the hook body 40), the through-holes 56 rotate in a direction away from the curved inner surface 47 of the hook body 40. Thus, the latching tool 50 can be rotated to the separated position in the state where the lock pin 60 is passed through the pair of through-holes 56.

Lock Pin 60

Figure 4A:
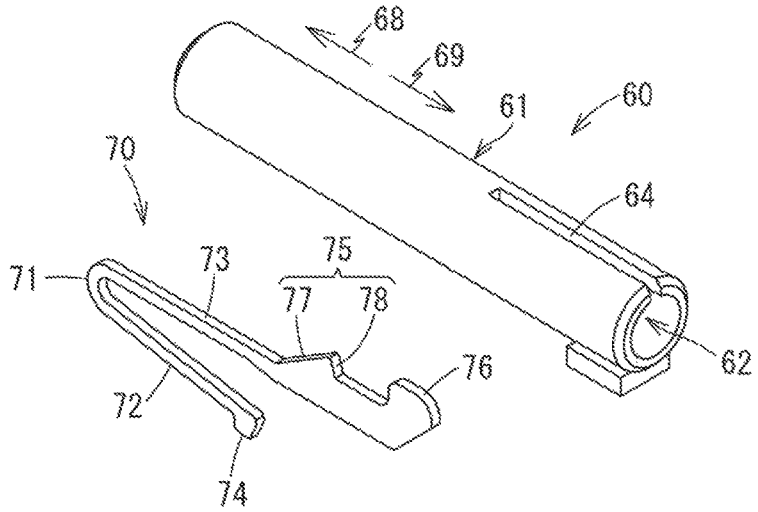
Figure 4B:
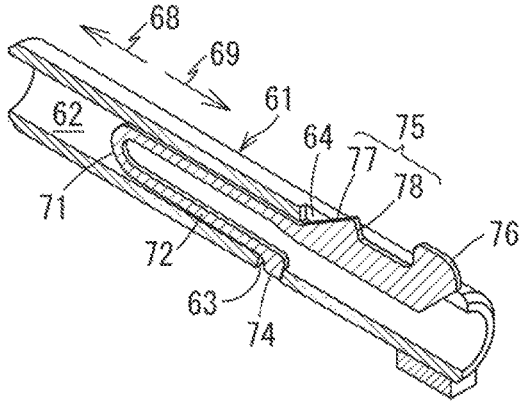
Figure 4C:
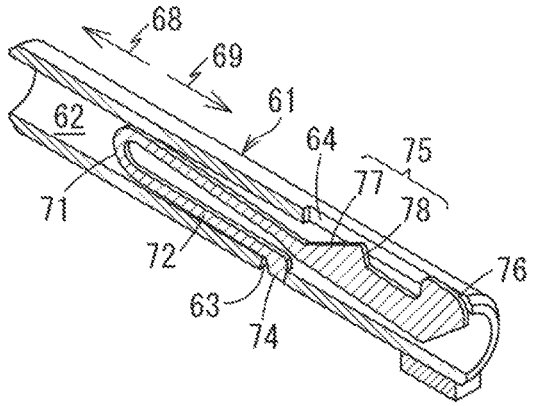

The lock pin 60 has a pin 61 and the engagement member 70 as illustrated in FIGS. 4A to 4C. The lock pin 60 is inserted into the through-holes 54 and 56 in a direction indicated by an arrow 68 of FIGS. 4A to 4C (hereinafter indicated as an "insertion direction 68") and is removed from the through-holes 54 and 56 in a direction indicated by an arrow 69 of FIGS. 4A to 4C (hereinafter indicated as a "removal direction 69"). More specifically, the insertion direction 68 and the removal direction 69 of the lock pin 60 each are a direction along the longitudinal direction of the lock pin 60 and are directions opposite to each other.

The pin 61 has a bar shape (in more detail, cylindrical shape) where the outer diameter size is smaller than the diameters of the through-holes 54 and 56. The pin 61 has an internal space 62 accommodating the engagement member 70, a through-hole (an example of the locking portion) 63 penetrating through the side surface of the pin 61 in the thickness direction, and a slit which penetrates the side surface of the pin 61 in the thickness direction and extends in the longitudinal direction of the pin 61. In the pin 61, both end portions in the longitudinal direction are opened. The through-hole 63 is formed at a substantially center portion in the longitudinal direction of the pin 61. A slit 64 is formed in a rear end portion in the insertion direction 68 of the pin 61. The through-hole 63 and the slit 64 are formed at a 180° interval in the circumferential direction of the pin 61.

The engagement member 70 is obtained by bending a long member formed with a metal material. The engagement member 70 has a first portion 72 of one side of a bent portion 71 and a second portion 73 of the other side of the bent portion 71. On the tip (position farthest from the bent portion 71) of the first portion 72, a portion to be locked 74 locked to the pin 61 is provided. On the tip of the second portion 73, an engagement portion 75 which is projected to the outside of the pin 61 and sunk into the pin 61 through the slit 64 and an operating portion 76 are provided.

The engagement portion 75 has a first inclined surface 77 and a second inclined surface 78. The first inclined surface 77 is directed in an insertion direction 68 of the lock pin 60 and the projection amount continuously decreases toward the insertion direction 68. The second inclined surface 78 is directed in a removal direction 69 of the lock pin 60 and the projection amount continuously decreases toward the removal direction 69. The first inclined surface 77 and the second inclined surface 78 contact each other at a position where the projection amounts become the maximum. More specifically, the engagement portion 75 has a convex shape containing the first inclined surface 77 extending in the insertion direction 68 from the vertex and the second inclined surface 78 extending in the removal direction 69 from the vertex. The inclination angle of the first inclined surface 77 is smaller than the inclination angle of the second inclined surface 78.

The engagement member 70 is in a state illustrated in FIG. 4A (an example of the natural state) in an unloaded state. As illustrated in FIGS. 4B and 4C, the engagement member 70 can be elastically deformed with the bent portion 71 as the base point in a direction where the first portion 72 and the second portion 73 are brought close to each other. Then the engagement member 70 in a state (an example of the compressed state) illustrated in FIGS. 4B and 4C tends to elastically return to the state illustrated in FIG. 4A.

The engagement member 70 is inserted into the internal space 62 of the pin 61 from the side of the bent portion 71 through a rear end portion in the insertion direction 68 of the pin 61. The engagement member 70 inserted into the pin 61 enters a compressed state in the internal space 62 as illustrated in FIG. 4B. The portion to be locked 74 is inserted into the through-hole 63 to be locked to the peripheral edge of the through-hole 63. Thus, the removal of the engagement member 70 from the internal space 62 is prevented. Furthermore, the engagement portion 75 and the operating portion 76 are projected to the outside of the pin 61 through the slit 64 due to the force for elastically returning to the natural state.

Operation of Detaching/Attaching Lock Pin 60 from/to the Latching Tool 50

Hereinafter, an example of detaching/attaching the lock pin 60 from/to the latching tool 50 from the side plate 52 side is described. First, when the lock pin 60 illustrated in FIG. 4B is inserted into the pair of through-holes 54 from the sideplate 52 side, the first inclined surface 77 of the engagement portion 75 abuts on the side plate 52 defining the peripheral edge of the through-hole 54. The attitude of the engagement member 70 illustrated in FIG. 4B is an example of the engaged attitude.

When the lock pin 60 is further pressed in the insertion direction 68 from the state, the engagement member 70 is elastically deformed in the direction where the first portion 72 and the second portion 73 are brought close to each other, so that the engagement portion 75 is sunk into the inside of the pin 61 as illustrated in FIG. 4C. Thus, the engagement portion 75 passes through the through-hole 54. The attitude of the engagement member 70 illustrated in FIG. 4C is an example of the disengaged attitude. Then, the engagement portion 75 passing through the through-hole 54 is elastically returned to the engaged attitude again. Thus, the attachment of the lock pin 60 to the latching tool 50 is completed.

When the latching tool 50 is attached to the lock pin 60, the engagement portion 75 is positioned between the pair of side plates 52 and 53 in the right and left direction 9 as illustrated in FIGS. 2A and 2B. The engagement portion 75 and the operating portion 76 are disposed in such a manner as to hold the side plate 52 therebetween from the right and left direction 9. More specifically, the movement in the insertion direction 68 of the lock pin 60 attached to the latching tool 50 is regulated by the engagement of the operating portion 76 and the side plate 52 and the movement in the removal direction 69 thereof is regulated by the engagement of the second inclined surface 78 of the engagement portion 75 and the side plate 52.

On the other hand, due to the fact that the operating portion 76 is pressed in a direction where the first portion 72 and the second portion 73 are brought close to each other, the engagement member 70 changes the attitude from the engaged attitude to the disengaged attitude. Then, by drawing out the lock pin 60 in this state in the removal direction 69, the lock pin 60 is detached from the latching tool 50. The same also applies to a case of inserting/removing the lock pin 60 into/from the through-holes 54 from the side plate 53 side. The same also applies to a case of inserting/removing the lock pin 60 into/from the through-holes 56.

Operational Effects of this Embodiment

According to the embodiment described above, the rotation of the latching tool 50 against the biasing force of the twisted coil spring 58 is regulated by the lock pin 60, and therefore the removal of the wire 37 or the like locked to the hook body 40 can be appropriately prevented. Moreover, since the attachment position (i.e., the position of the through-holes 54) of the lock pin 60 is close to the rotation tip 51A of the latching tool 50, an operation of detaching/attaching the lock pin 60 from/to the latching tool 50 and an operation of detaching/attaching the wire 37 and the like from/to the hook body 40 can be smoothly performed.

Moreover, according to the embodiment described above, the lock pin 60 is supported at two places by the pair of side plates 52 and 53 and abuts on the hook body 40 between the support positions, and therefore the rotation of the latching tool 50 can be stably regulated. Furthermore, by passing the lock pin 60 through the through-holes 56 when rotating the latching tool 50, the rotation of the latching tool 50 is not blocked and the loss or the like of the lock pin 60 can be prevented.

Moreover, according to the embodiment described above, the engagement member 70 accommodated in the internal space 62 of the pin 61 tends to return to the natural state from the compressed state to cause the engagement portion 75 to project from the slit 64. Thus, the engaged attitude of the engagement member 70 is maintained, and therefore the removal of the lock pin 60 from the latching tool 50 due to vibration or the like can be prevented.

Moreover, according to the embodiment described above, by reducing the inclination angle of the first inclined surface 77 to be smaller than the second inclined surface 78, the engagement portion 75 is easily sunk into the pin 61 in the insertion of the lock pin 60 and the engagement portion 75 is not easily sunk into the pin 61 in the removal of the lock pin 60. As a result, the insertion of the lock pin 60 is facilitated and also unexpected removal of the lock pin 60 from the latching tool 50 can be prevented.

Furthermore, according to the embodiment described above, by operating the operating portion 76 to cause the engagement portion 75 to sink into the pin 61, the lock pin 60 can be drawn out of the latching tool 50. As a result, unexpected removal of the lock pin 60 from the latching tool 50 is prevented and also the lock pin 60 can be easily removed from the latching tool 50.

The specific configuration of the regulating member according to the present invention is not limited to the lock pin 60 illustrated in FIGS. 4A to 4C. Hereinafter, lock pins 80 and 100 according to modifications are described with reference to FIGS. 5A to 5C and FIGS. 6A to 6C. A detailed description of points common to the lock pin 60 illustrated in FIGS. 4A to 4C and the lock pins 80 and 100 is omitted and a description is given focusing on differences therebetween.

Modification 1

Figure 5A:
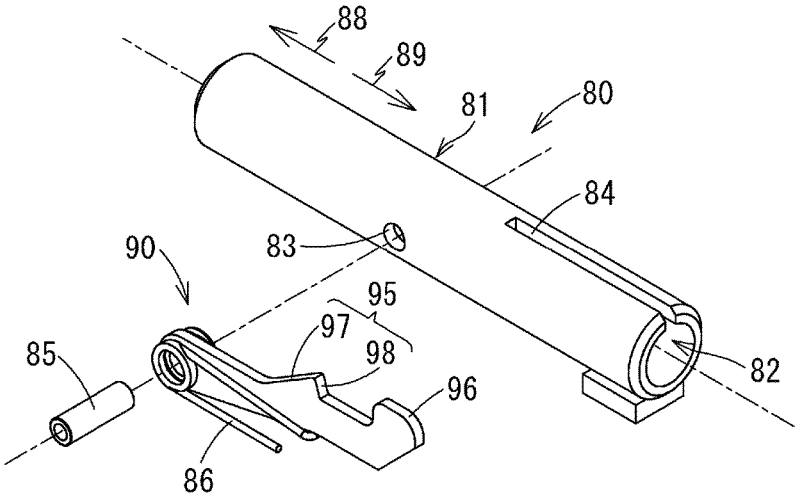
Figure 5B:
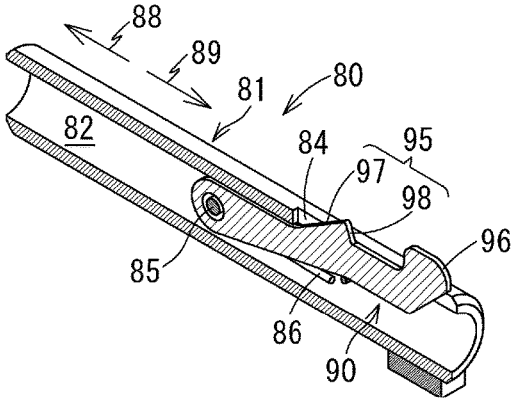
Figure 5C:
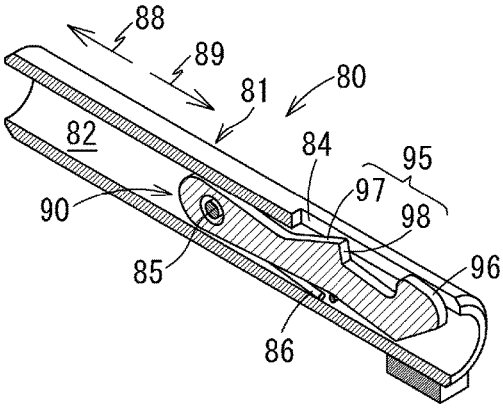

The lock pin 80 according to modification 1 has a pin 81, a shaft 85, a twisted coil spring (an example of the biasing member) 86, and the engagement member 90 as illustrated in FIGS. 5A to 5C. The pin 81 has an internal space 82, a pair of through-holes (Only one through-hole is illustrated in FIGS. 5A to 5C.) 83 penetrating the side surface of the pin 81 in the thickness direction, and a slit 84. The pair of through-holes 83 are formed at an interval of 180° in the circumferential direction of the pin 81 at positions corresponding to each other in the insertion direction 88 and in the removal direction 89. The shaft 85 is fixed to the pin 81 by being inserted into the pair of through-holes 83. More specifically, the shaft 85 is extended in the lateral direction of the pin 81.

The engagement member 90 is a long member, one end of which is rotatably supported by the shaft 85 and at the other end of which an engagement portion 95 and an operating portion 96 are provided. The engagement portion 95 has a first inclined surface 97 and a second inclined surface 98. The engagement member 90 accommodated in the internal space 82 changes the attitude between an engaged attitude illustrated in FIG. 5B and a disengaged attitude illustrated in FIG. 5C by the rotation around the shaft 85. The twisted coil spring 86 is accommodated in the internal space 82 in a state where a coil portion is passed through the shaft 85. Due to the fact that one arm is caused to abut on the inner surface of the pin 81 and the other arm is caused to abut on the engagement member 90, the twisted coil spring 86 biases the engagement member 90 to the engaged attitude.

Modification 2

Figure 6A:
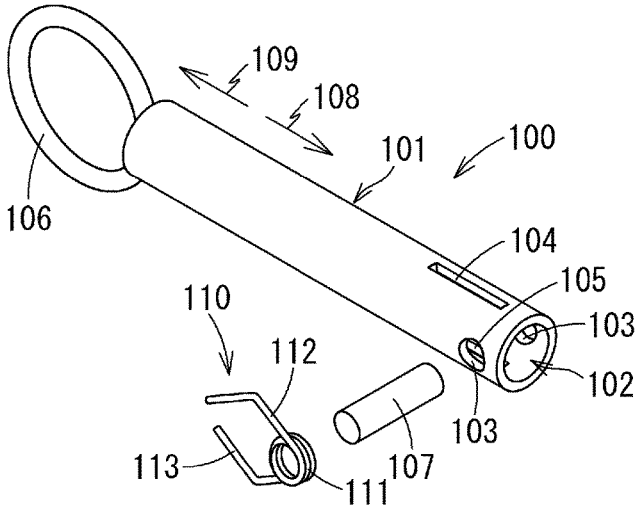
Figure 6B:
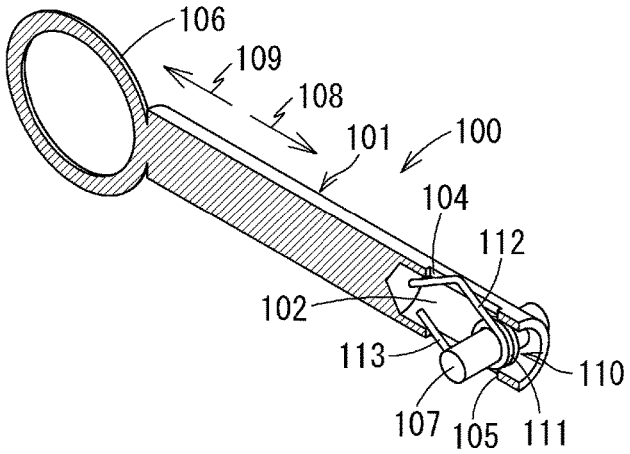
Figure 6C:
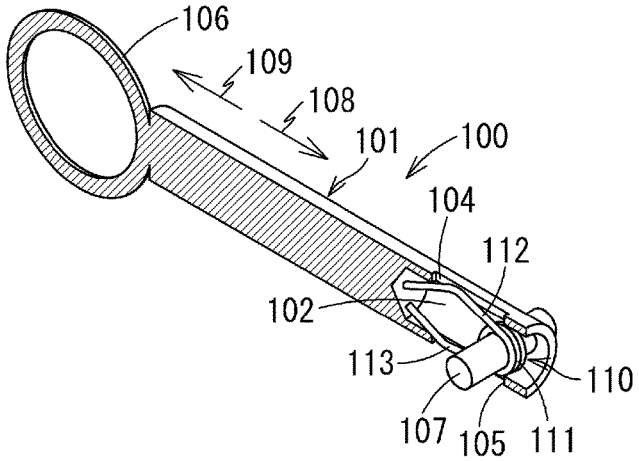

The lock pin 100 according to modification 2 has a pin 101, a shaft 107, and the engagement member 110 as illustrated in FIGS. 6A to 6C. The pin 101 has an internal space 102, a pair of through-holes 103, slits 104 and 105, and a holding portion 106 held when detaching/attaching the lock pin 100 from/to the latching tool 50.

The pair of through-holes 103 are formed at an interval of 180° in the circumferential direction of the pin 101 at positions corresponding to each other in the insertion direction 108 and in the removal direction 109. The slits 104 and 105 are formed at an interval of 180° in the circumferential direction of the pin 101 on the tip side in the insertion direction 108 of the pin 101. The holding portion 106 is attached to a rear end side in the insertion direction 108 of the pin 101. The shaft 107 is fixed to the pin 101 by being inserted into the pair of through-holes 103. More specifically, the shaft 107 is extended in the lateral direction of the pin 101.

The engagement member 110 is a twisted coil spring. More specifically, the engagement member 110 has a coil portion 111 in which a linear member is formed in a coil shape, a first arm portion 112 extended from one end portion of the coil portion 111, and a second arm portion 113 extended from the other end portion of the coil portion 111. The first arm portion 112 and the second arm portion 113 each are bent at a substantially central portion in the longitudinal direction.

As illustrated in FIG. 6B, the engagement member 110 is accommodated in the internal space 102 in a state where the coil portion 111 is passed through the shaft 107. The coil portion 111 of the engagement member 110 accommodated in the internal space 102 is twisted in a direction where the first arm portion 112 and the second arm portion 113 are brought close to each other. Thus, the engagement member 110 tends to elastically return in a direction where the first arm portion 112 and the second arm portion 113 are separated from each other to cause the bent portion of the first arm portion 112 to project from the slit 104 and cause the bent portion of the second arm portion 113 to project from the slit 105. More specifically, the bent portion of each the first arm portion 112 and the second arm portion 113 functions as an engagement portion.

As illustrated in FIG. 6C, when the lock pin 100 is detached from/attached to the latching tool 50, the first arm portion 112 and the second arm portion 113 which are caused to abut on the side plates 52 and 53 defining the peripheral edge of the through-holes 54 are sunk into the pin 101. The coil portion 111 at this time is further twisted than the twisted state of FIG. 6B. Then, the first arm portion 112 and the second arm portion 113 passing through the side plates 52 and 53 are projected to the outside of the pin 101 through the slits 104 and 105 by the coil portion 111 which tends to elastically return.

Furthermore, a method for regulating the removal of the lock pins 60, 80, and 100 from the latching tool 50 is not limited to the examples described above. For example, the removal of the lock pins 60, 80, and 100 from the latching tool 50 may be regulated by attaching a so-called β pin to the through-holes provided in the lock pins 60, 80, and 100 in the insertion directions 68, 88, and 102.

Modification 3

Figure 7:
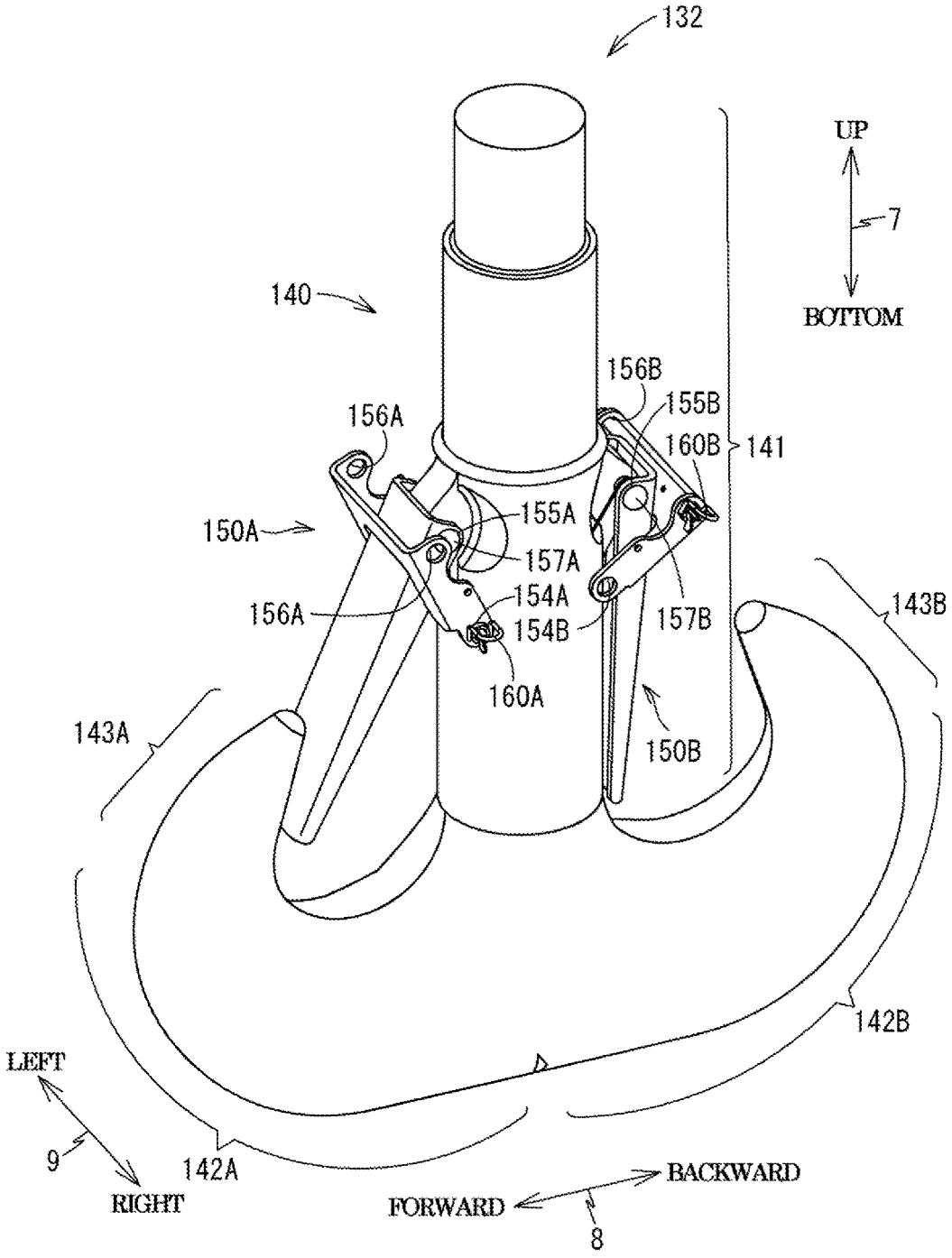
FIG. 7 is a perspective view of a hook 132 according to modification 3.

The shape of the crane hook according to the present invention is not limited to the examples of FIGS. 2A and 2B and FIG. 3. A hook 132 according to modification 3 has a hook body 140, two latching tools 150A and 150B, and two lock pins 160A and 160B as illustrated in FIG. 7, for example. A detailed description of points common to the embodiment or the modifications 1 and 2 described above is omitted and a description is given focusing on differences therebetween. The lock pins 160A and 160B may be any of the lock pins 60, 80, and 100 described above.

The hook body 140 is a so-called double hook having a curved portion 142A which is curved from a base end portion 141 to the front side and a curved portion 142B which is curved from the base end portion 141 to the rear side, and the base end portion 141 is shared. The latching tools 150A and 150B each are rotatably supported by the base end portion 141 and are brought into contact with and separated from the curved inner surface of tip end portions 143A and 143B continuous to the curved portions 142A and 142B. The latching tool 150A may have a first member in which a pair of through-holes 154A and 156A supporting the lock pin 160A are formed and a second member in which a pair of through-holes 155A rotatably supporting a shaft 157A are formed. The same also applies to the latching tool 150B.

By inserting the lock pin 160A into the pair of through-holes 154A in the hook 132 of the configuration described above as illustrated in FIG. 7, the rotation of the latching tool 150A to the separated position is regulated. By removing a lock pin 160B from a pair of through-holes 154B, the latching tool 150B can rotate between the abutting position and the separated position. More specifically, according to the hook 132 of the modification 3, the rotation of the two latching tools 150A and 150B can be permitted or regulated independently from each other.

What is claimed is:

1. A crane hook being suspended from a rope, said crane hook comprising:

a hook body having an attachment portion to be attached to the rope at a base end portion and being curved in an L-shaped from the base end portion to a tip end portion;

a shaft being fixed to the hook body;

a rotation member being rotatably supported by the shaft and having an abutment portion to be brought into contact with and separated from a curved inner surface of the hook body on a side of the tip end portion of the hook body relative to the shaft;

a biasing member biasing the rotation member in a direction where the rotation member is caused to abut on the hook body; and a regulating member being detachable from and attachable to the rotation member, wherein the rotation member has a plurality of through-holes penetrating in an extending direction of the shaft, the through-holes including:

a first through-hole through which the regulating member is passed, a second through-hole into which the shaft is passed at position distant from the abutment portion relative to the first through-hole, and a third through-hole through which the regulating member is passed at position distant from the abutment portion relative to the second through-hole, and the regulating member abuts on a curved inner surface of the hook body when the regulating member is passed through the first through-hole to regulate rotation of the rotation member against biasing force of the biasing member, and permits the rotation of the rotation member when the regulating member is passed through the third through-hole.

2. The crane hook according to claim 1, wherein the rotation member has:

a main plate having a rotation tip serving as the abutment portion; and a pair of side plates being extended in a direction crossing the main plate from both end portions in a rotation axis direction of the main plate and each having the first through-hole, the second through-hole and the third through-hole.

3. The crane hook according to claim 2, wherein the regulating member contains:

a bar-shaped pin having an outer diameter size smaller than a diameter of the first through-holes; and an engagement member capable of changing an attitude between an engaged attitude in which the engagement member is engaged with the side plate defining a peripheral edge of the first through-hole and a disengaged attitude in which engagement with the side plate is released.

4. The crane hook according to claim 3, wherein the engagement member has:

an engagement portion provided at a position where the regulating member passes through at least one of the pair of first through-holes when the regulating member is attached to the rotation member, and the engagement member changes an attitude to the engaged attitude in which the engagement portion is projected from the pin and the disengaged attitude in which the engagement portion is sunk into the pin and is biased in a direction where the engaged attitude is maintained.

5. The crane hook according to claim 4, wherein the engagement member is formed by bending a long member, the engagement member elastically deformed with a bent portion as a base point tends to return to a natural state where a first portion of one side of the bent portion and a second portion of the other side of the bent portion are separated from each other by only a predetermined distance, the engagement portion is provided in the second portion, and the pin has:

an internal space accommodating the engagement member in a compressed state in which the first portion and the second portion are closer to each other than the natural state;

a locking portion locking the first portion of the engagement member accommodated in the internal space; and a slit from and into which the engagement portion of the engagement member accommodated in the internal space is projected and sunk.

6. The crane hook according to claim 5, wherein the engagement portion has:

a first inclined surface where a projection amount continuously decreases toward an insertion direction of the pin; and a second inclined surface where the projection amount continuously decreases toward a removal direction of the pin, and an inclination angle of the first inclined surface is smaller than an inclination angle of the second inclined surface.

7. The crane hook according to claim 5, wherein the slit is formed in a rear end portion in the insertion direction of the pin, the engagement member has an operating portion being exposed from the pin on a rear side in the insertion direction of the pin relative to the engagement portion and causing the engagement portion to sink into the pin by being operated by an operator, and when the regulating member is attached to the rotation member, the regulating member is disposed in such a manner as to hold the side plate on a rear side in the insertion direction of the pin between the engagement portion and the operating portion.

8. The crane hook according to claim 4, wherein the pin has:

an internal space accommodating the engagement member having a long shape;

a shaft extending in a lateral direction of the pin and rotatably supporting the engagement member;

a slit from and into which the engagement portion is projected and sunk; and a biasing member biasing the engagement member in a direction where the engagement portion is projected through the slit.

9. The crane hook according to claim 4, wherein the engagement member has:

a coil portion in which a linear member is formed in a coil shape;

a first arm portion being extended from one end portion of the coil portion and being bent; and a second arm portion being extended from the other end portion of the coil portion and being bent, the engagement portion includes the bent portions of the first arm portion and the second arm portion, and the pin has:

an internal space accommodating the engagement member in a state where the coil portion is twisted in a direction where the first arm portion and the second arm portion are brought close to each other;

a shaft extending in a lateral direction of the pin and being passed through the coil portion;

a first slit from and into which the engagement portion of the first arm portion is projected and sunk; and a second slit from and into which the engagement portion of the second arm portion is projected and sunk.

10. A crane truck comprising:

a traveling body;

a slewing body slewably supported by the traveling body;

a boom derrickably and telescopably supported by the slewing body, and the crane hook according to claim 1 suspended from a tip end portion of the boom with a rope.

* * * * *